US006637811B2

(12) United States Patent
Zheng

(10) Patent No.: US 6,637,811 B2
(45) Date of Patent: Oct. 28, 2003

(54) COLLAPSIBLE BEACH CHAIR WITH TENSIONED SEAT

(76) Inventor: Edward Zheng, 876 Everest Dr., Chino Hills, CA (US) 91709

( * ) Notice: Subject to any disclaimer, the term of this patent is extended or adjusted under 35 U.S.C. 154(b) by 0 days.

(21) Appl. No.: 10/041,962

(22) Filed: Dec. 19, 2001

(65) Prior Publication Data

US 2003/0111874 A1 Jun. 19, 2003

(51) Int. Cl.[7] ..... A47C 4/44
(52) U.S. Cl. ..... 297/31; 297/16.2; 297/45
(58) Field of Search ..... 297/16.1, 16.2, 297/31, 45, 34, 46, 47

(56) References Cited

U.S. PATENT DOCUMENTS 4,386,790 A * 6/1983 Kassai ..... 297/45
6,179,374 B1 * 1/2001 Tang ..... 297/45
6,454,348 B1 * 9/2002 Wu ..... 297/16.2

* cited by examiner

*Primary Examiner*—Peter R. Brown
(74) *Attorney, Agent, or Firm*—Rutan & Tucker; Robert D. Fish

(57) ABSTRACT

A collapsible chair has a pair of front legs, a pair of rear legs, a pair of back support rods, a seat, and a cross brace that slidably couples one of the back support rods to one end of the cross brace and one of the front legs. The legs, support rods and cross brace are coupled such that the chair collapses in a single movement in which the front legs approximate each other when the seat pivots towards the back support rods.

17 Claims, 2 Drawing Sheets

FIG. 1A
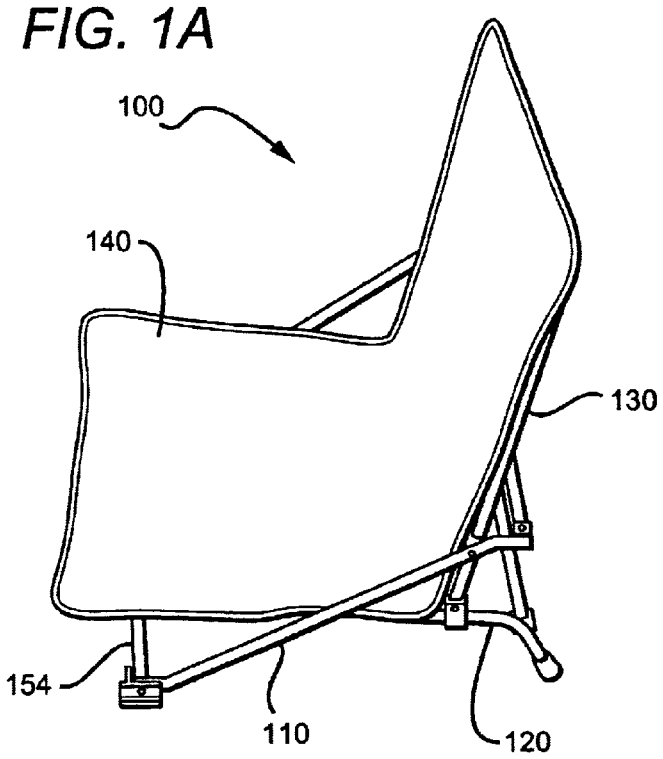
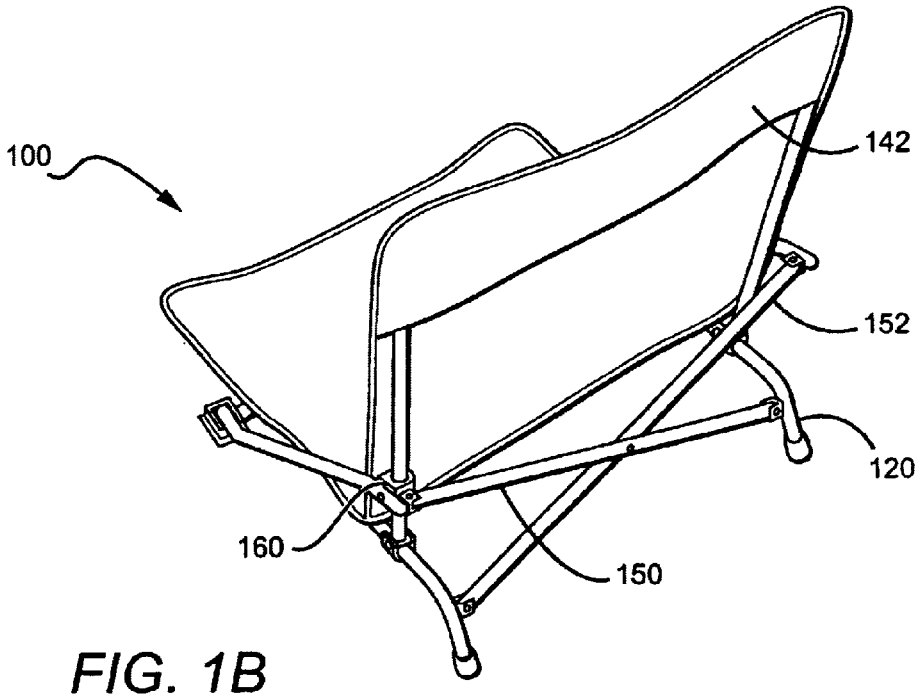
FIG. 1B

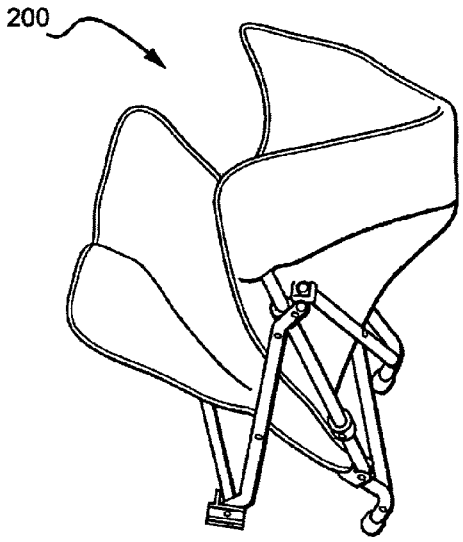
FIG. 2
FIG. 3
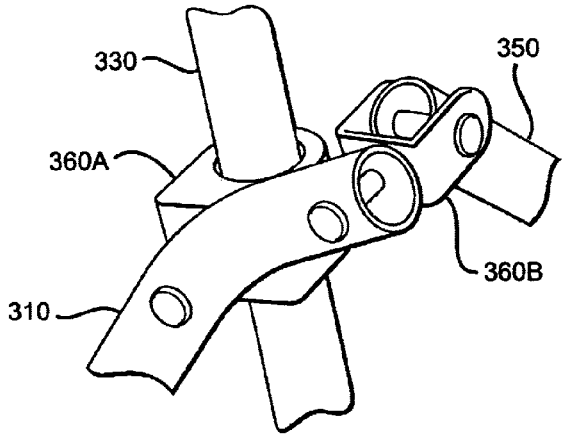
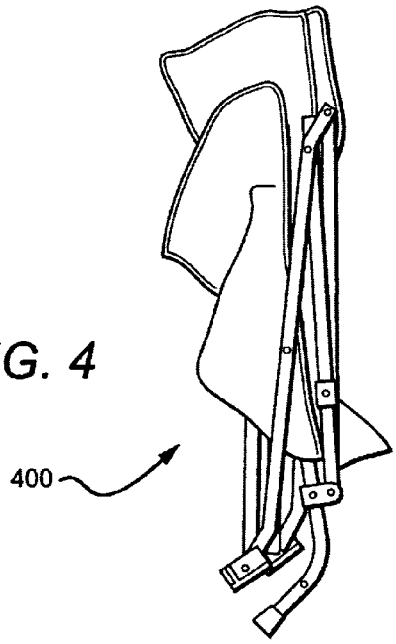
FIG. 4

COLLAPSIBLE BEACH CHAIR WITH TENSIONED SEAT

FIELD OF THE INVENTION

The field of the invention is collapsible furniture.

BACKGROUND OF THE INVENTION

Folding chairs are relatively popular, because they can be stored with considerably reduced space requirements when compared to non-folding chairs. Nevertheless, folding chairs still require relatively large space, since the dimension of the folding chair is generally reduced only along one space coordinate (e.g., reduced length). To further reduce the space requirement, collapsible chairs have been developed, in which further size reduction is achieved by folding the chair along at least two space coordinates (e.g., length and width). Various collapsing chairs are known in the art.

For example, Cook et al. describes in U.S. Pat. No. 5,921,621 a collapsible chair with a foldable backrest, in which the chair has four legs that support the corners of a flexible square seat. The legs are movably attached to each other at about their respective midpoints, and the seat is collapsed in width and depth by turning the legs around the midpoint. While Cooks chair is relatively easy to unfold and collapse, Cooks chair provides relatively little stability and is prone to tipping over.

Improved stability can be achieved by including slidable cross bars between the legs as described in U.S. Pat. No. 6,082,813 to Chen and U.S. Pat. No. 5,984,406 to Lee. Chen's chair advantageously collapses to a relatively compact form. However, the position of the back support is limited to a vertical position, which may not be comfortable over a prolonged period. On the other hand, Lee's chair provides an angled backrest, although it lacks a seat support entirely.

In addition to the problems of the collapsible chairs mentioned above, all or almost all of the known collapsible chairs suffer from a common disadvantage in that the seat will loose tension once the seat supports the weight of a person. Moreover, where known chairs are collapsible in a single motion, such chairs do typically fail to provide a seat support rod onto which the seat can be tensioned. Alternatively, where known chairs have a pair of seat support rods, such chairs generally require at least two folding motions (e.g., one motion in which the seat is folded upwards followed by one motion in which the seat is folded in a side-to-side movement). Therefore, there is a need to provide improved methods and apparatus for collapsible chairs.

SUMMARY OF THE INVENTION

The present invention is directed to a collapsible chair that can be collapsed in a single motion. In particular, contemplated collapsible chairs have a pair of front legs, a pair of rear legs, a pair of back support rods, a seat, and a cross brace with a first and second end, the first end coupled to one of the rear legs, and the second end slidably coupled to one of the back support rods via a coupling element. In contemplated collapsible chairs, the seat is coupled to the pair of rear legs, and the coupling element further slidably couples one of the front legs to the one of the back support rods, wherein the front legs, the rear legs, the cross brace, and the back support rods are coupled in a manner such that the chair collapses in a single movement in which the front legs approximate each other when the seat pivots towards the back support rods.

In one aspect of the inventive subject matter, at least one of the pair of front legs is rotatably coupled to at least one of the pair of rear legs, and contemplated collapsible chairs may further comprise a second cross brace with a first and second end, the first end coupled to one of the front legs, and the second end coupled to one of the rear legs. It is further contemplated that coupling elements may further rotatably couple one of the rear legs and one of the front legs to one of the back support rods.

In another aspect of the inventive subject matter, a backrest is coupled to the pair of back support rods, and the seat is a tensioned seat, and it is generally preferred that the backrest is continuous with the tensioned seat and comprises a weather resistant fabric (e.g., Nylon). It is also preferred that at least one of the pair of front legs, the pair of rear legs, and the back support rods is manufactured from aluminum.

In a further aspect of the inventive subject matter, a method of imparting collapsibility into a chair comprise one step in which a pair of front legs, a pair of rear legs, a pair of back support rods, a seat, a coupling element, and a cross brace with a first and second end are provided. In a further step, the second end of the cross brace is slidably coupled to one of the back support rods via the coupling element. In a still further step, one of the front legs is slidably coupled to the one of the back support rods via the coupling element, and in yet another step, a seat is coupled to the pair of rear legs, wherein the front legs, the rear legs, the cross brace, and the back support rods are coupled in a manner such that the chair collapses in a single movement in which the front legs approximate each other when the seat pivots towards the back support rods.

Various objects, features, aspects and advantages of the present invention will become more apparent from the following detailed description of preferred embodiments of the invention, along with the accompanying drawings, in which like numerals represent like components.

BRIEF DESCRIPTION OF THE DRAWING

FIGS. 1A and 1B are perspective views of an exemplary collapsible beach chair.

FIG. 2 is a perspective view of the chair of FIGS. 1A and 1B in a partially collapsed configuration.

FIG. 3 is a perspective view of an exemplary coupling element.

FIG. 4 is a perspective view of the chair of FIGS. 1A and 1B in a fully collapsed configuration.

DETAILED DESCRIPTION

It is generally contemplated that a collapsible beach chair includes a seat coupled to a pair of rear legs, and that the chair can be collapsed in a single motion. Contemplated chairs have a pair of front legs, a pair of rear legs, a pair of back support rods, a seat, and a cross brace with a first and second end, the first end coupled to one of the rear legs, and the second end slidably coupled to one of the back support rods via a coupling element. In contemplated chairs, the coupling element further slidably couples one of the front legs to the one of the back support rods, wherein the front legs, the rear legs, the cross brace, and the back support rods are coupled in a manner such that the chair collapses in a single movement in which the front legs approximate each other when the seat pivots towards the back support rods.

In FIGS. 1A and 1B, a collapsible chair 100 has a pair of front legs 110 (only one front leg shown), a pair of rear legs

120, a pair of back support rods 130 (only one back support rod shown), and a seat 140 coupled to the pair of rear legs. A backrest 142 (continuous with the seat) is coupled to the pair of back support rods. Chair 100 further comprises a pair of cross braces 150 and 152, wherein both cross braces have a first and a second end. A second cross brace 154 is couples one front leg with a rear leg on the opposite side of the chair. The chair 100 further has a coupling element 160, which slidably and rotatably couples one end of the cross brace and the front leg to one of the back support rods.

FIG. 2 depicts the collapsible chair (200) of FIGS. 1A and 1B in a partially collapsed configuration. Here, while the chair collapses, the slidable coupling element travels along the back support rod, and the front leg rotates relative to the rear leg around a pivot point common to front and rear leg. FIG. 3 depicts an exemplary coupling element that comprises 2 separate portions 360A and 360B, wherein the coupling element slidably couples front leg 310 and cross brace 350 to back support rod 330. First portion 360A slidably engages with the back support rod, while rotatably engaging with front leg 310 and second portion 360B. Second portion 360B rotatably and pivotally couples cross brace 350 with the front leg 310 (which is slidably coupled to the back support rod). Thus, the cross brace 350 is also slidably coupled to the back support rod 330. FIG. 4 depicts the collapsible chair (400) of FIGS. 1A and 1B in a substantially completely collapsed configuration.

It is generally contemplated that the seat and the backrest are fabricated from a weather resistant material, preferably a woven synthetic polymer (e.g., Nylon) and has a colored pattern (e.g., yellow stripes on white background). Particularly preferred seats have a width of about 21 inches and an overall length of about 24 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, or no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 21 inches, and suitable widths include 21–24, 24–30, and 30–40 inches, and wider, but also 18–21, 14–18, and 8–14 inches, and narrower. Likewise, the length of appropriate seats may vary between 20–42, 15–10, and 12–15 inches and less, but also between 24–27, 27–30, and more. It should further be appreciated that contemplated seats may also be tapered from the front end to the back end, or vice versa.

With respect to the backrest it is contemplated that the backrest is fabricated from the same material as the seat, and that the backrest is removably or permanently coupled to the seat (e.g., sewed, coupled with a zipper, etc.) Thus, it is preferred that the backrest has a width of about 21 inches. A preferred height of the backrest is about 18 inches. With respect to the material and color, it is contemplated that the same considerations as for the seat apply. It is further contemplated that the width and height of suitable backrests may vary, and that width and height will depend among other things on the person's size and the number of persons to be seated in the chair. Thus, alternative backrests may have a width between 18–12 inches and less, but also between 18–22 and more. Similarly, contemplated backrests may have a height between 12–18 inches and less, but also between 18–25 inches and more.

It is generally contemplated that the seat and the backrest may be coupled to the legs and back support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadbly securable elements (e.g., laces threaded through rings). Permanent couplings include sewed or glued elements. For example, the backrest may permanently coupled to the chair via a rivet. On the other hand, the front end of the seat may be temporarily coupled to the front legs via ring-shaped openings slided over the top ends of the front legs. It is further, particularly preferred that the seat and the backrest are coupled together.

It should further be appreciated that the attachment of the seat and/or the backrest to the chair may be directly or indirectly attached. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the rear legs via a slidable pouch. Alternatively, the seat may be indirectly coupled to the rear legs via a ring-shaped opening in the seat that slidably engages with the rods.

With respect to the legs, back support rods, and cross braces of contemplated chairs, it should be appreciated that all of these elements may be manufactured from various materials, including metals, metal alloys, natural and synthetic polymers, and any reasonable combination thereof. However, it is preferred that the legs, back support rods, and cross braces are manufactured from black anodized aluminum tubing with a wall strength of about 1/32 inch and an outer diameter of approximately 12 inch. Preferred alternative materials include stainless steel, fiberglass, and wood. Furthermore, where the legs and/or cross braces contact the ground when the chair is in operation (i.e., supporting a person), it is contemplated that additional pads or other elements may be employed that transfer the weight of the person to the ground and/or function as pivot point or point of rotation.

Where one of the legs, back support rods, and cross braces is pivotably coupled to another one of the legs, back support rods, and cross braces, it is generally contemplated that all known manners of coupling rotatably are suitable for use in conjunction with the teachings presented herein. For example, appropriate manners of coupling rotatably include coupling of two elements via a common axis, coupling via a hinge wherein the hinge may or may not have a slidable connection to another element, coupling via a ball bearing, etc. Similarly, where one of the legs, back support rods, and cross braces is slidably coupled to another one of the legs, back support rods, and cross braces, all known slidable couplings are contemplated to be appropriate, and include a sliding sleeve, slide rails, guiding rings, etc.

In a preferred aspect, a collapsible chair has two front legs, two rear legs, and two back support rods, wherein a first pair of cross braces is slidably and rotatably coupled to the back support rods, and rotatably and pivotally coupled to the rear legs. The cross braces are rotatably coupled to each other around a common axis, and it is further preferred that at least one of the front legs is rotatably coupled to at least one of the rear legs. A second pair of cross braces is rotatably and pivotally coupled to each of the front legs and the opposite rear legs. The pair of back support rods are pivotally coupled to the respective rear legs, and the front legs are slidably and rotatably coupled to the back support rods. In such preferred configuration, the slidable and rotatable coupling of the front legs and cross braces to the back support rods is implemented via a coupling element.

While in some aspects contemplated coupling element comprise a first and second portion as depicted in FIG. 3, it should be appreciated that numerous alternative coupling elements are also suitable, so long as such coupling elements slidably and rotatably/pivotally couple one end of the cross brace to the back support rod and slidably and rotatably/pivotally couple the front leg to the back support rod. Thus, suitable coupling elements may comprise a single piece that imparts all of the required operations, but may also comprise two, three or more pieces. For example, second portion 260B in FIG. 3 may be integrated into first portion 260A. Alternatively, an additional first portion 360A' may be placed above first portion 360A, wherein the additional portion 360A' is rotatably/pivotally coupled to the cross brace.

It is particularly preferred, that all of the front legs, rear legs and back support rods are coupled through the cross braces and the coupling elements in a manner that allows collapsing the chair in a single movement, i.e., the front legs (and rear legs) approximate each other when the seat pivots towards the back support rods. In preferred configurations, the seat pivots downwardly and the back legs move apart when the chair is unfolded in an extended configuration. As viewed from another perspective, it is preferred that the seat and backrest fold when the front legs approximate.

Thus, a method of imparting collapsibility into a chair has one step in which a pair of front legs, a pair of rear legs, a pair of back support rods, a seat, a coupling element, and a cross brace with a first and second end are provided. In another step, the second end of the cross brace is slidably coupled to one of the back support rods via the coupling element, and in yet another step, one of the front legs is slidably coupled to the one of the back support rods via the coupling element. In still another step, a seat is coupled to the pair of rear legs, wherein the front legs, the rear legs, the cross brace, and the back support rods are coupled in a manner such that the chair collapses in a single movement in which the front legs approximate each other when the seat pivots towards the back support rods.

It should be recognized that such preferred coupling may be realized in various configurations. In an exemplary configuration of preferred chairs, and for each side of the chair, one front leg and one end of a cross brace (coupling the rear leg of one side with the back support rod of the other side) are slidably and rotatably coupled to a back support rod, which is pivotally coupled to the rear leg. At the same time, each of the rear legs and front legs are rotatably coupled to each other via a common axis. A second pair of cross braces rotatably and pivotally connect each of the front legs with the opposing rear legs.

However, it should be appreciated that in alternative aspects of the inventive subject matter the number of legs, and/or back supports may vary considerably. For example, where the chair is sized and dimensioned to accommodate more than one person, three, four, or more legs, and/or back supports may be included. On the other hand, where stability of the seat is particularly desirable, three or more rear legs may be included in a chair with two front legs and two back support rods. Likewise, the number of cross braces may vary, and while some chairs may have only one pair of cross braces, other chairs may include three, four, or more cross braces.

Furthermore, it should be appreciated that the coupling may vary depending on the particular configuration of contemplated chairs. For example it is contemplated that all of the couplings may be rotatable and slidable. Alternatively, where slidable couplings are less desirable, alternative couplings may be employed and suitable couplings especially include temporary couplings such as snap connectors, connectors that are secured with a pin or other removable element, etc. In still further alternative aspects of the inventive subject matter, the coupling may be done via an intermediate rod, that rotatably couples two elements together.

It should be especially appreciated that in contemplated configurations of collapsible chairs, the seat is tensioned when the first and the second front legs move apart, and that the seat remains substantially tensioned when the seat supports a person. The term "tensioned seat" means that the seat is substantially level when the chair is in the open configuration, wherein the term "substantially level" means that the vertical distance between any point of the seat and the rear legs is no more than one 0.75 inch, more preferably no more than 0.5 inch, and most preferably no more than 0.25 inch. The term "open configuration" refers to the configuration of the collapsible chair in which the front legs have a maximum distance from each other when the chair is opened using reasonable force (i.e. without damaging the mechanical structure). The term "remains substantially tensioned" means that the vertical distance between the lowest point of the seat and the rear legs increases no more than one inch, preferably no more than 0.75 inch, more preferably no more than 0.5 inch, and most preferably no more than 0.25 inch. Thus, it should be recognized that the tension of the seat is predominantly determined by the firmness of the material of the seat.

While not whishing to be bound by a particular theory, it is contemplated that the tension in the seat remains substantially tensioned due to mechanically coupling an approximating movement of the rear legs with a simultaneous movement of the seat upwards towards the back support rods. Viewed from another perspective, it should be recognized that while all or almost all of the prior art chairs with a seat support rod require at least two separate folding operations to collapse the chair, contemplated collapsing chairs are folded in a single movement (comparably to the collapsing of an umbrella). Moreover, it should be recognized that contemplated modes of coupling the front leg with the rear leg and the back support rod prevent loss of tension of the seat when a person is supported by the chair.

Thus, specific embodiments and applications of collapsible chairs have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comrises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair, comprising:

a pair of front legs, a pair of rear legs, a pair of back support rods, a seat having a first side and a second side, and a cross brace with a first and second end, the first end coupled to one of the rear legs, and the second end slidably coupled to one of the back support rods via a coupling element;

wherein the coupling element further slidably couples one of the front legs to the one of the back support rods;

wherein the first and second sides of the seat are coupled along at least part of their length to the pair of rear legs, respectively, such that the seat is supported between the rear legs; and wherein the front legs, the rear legs, the cross brace, and the back support rods are coupled in a manner such that the chair collapses in a single movement in which the front legs approximate each other when the seat pivots towards the back support rods.

2. The collapsible chair of claim 1 wherein at least one of the pair of front legs is rotatably coupled to at least one of the pair of rear legs.

3. The collapsible chair of claim 1 further comprising a second cross brace with a first and second end, the first end coupled to one of the front legs, and the second end coupled to one of the rear legs.

4. The collapsible chair of claim 1 wherein a backrest is coupled to the pair of back support rods, and the seat is a tensioned seat.

5. The collapsible chair of claim 4 wherein the backrest is continuous with the tensioned seat.

6. The collapsible chair of claim 4 wherein the backrest comprises a weather resistant fabric.

7. The collapsible chair of claim 1 wherein the coupling element further slidably and rotatably couples the cross brace to the one of the back support rods.

8. A method of imparting collapsibility into a chair, comprising:

providing a pair of front legs, a pair of rear legs, a pair of back support rods, a seat having a first side and a second side, a coupling element, and a cross brace;

slidably coupling one end of the cross brace to one of the back support rods via the coupling element;

slidably coupling one of the front legs to the one of the back support rods via the coupling element;

coupling the first and second sides of the seat along at least part of their length to the pair of rear legs, respectively, such that the seat is supported between the rear legs; and wherein the front legs, the rear legs, the cross brace, and the back support rods are coupled in a manner such that the chair collapses in a single movement in which the front legs approximate each other when the seat pivots towards the back support rods.

9. The method of claim 8 further comprising rotatably coupling at least one of the pair of front legs to at least one of the pair of rear legs.

10. The method of claim 8 further comprising providing a second cross brace with a first and second end, and coupling the first end to one of the front legs, and coupling the second end to one of the rear legs.

11. The method of claim 8 further comprising coupling a backrest to the pair of back support rods.

12. The method of claim 11 wherein the backrest is continuous with the seat.

13. The method of claim 12 wherein the backrest comprises a weather resistant fabric.

14. The method of claim 8 wherein the coupling element further rotatably and slidably couples the cross brace to the one of the back support rods.

15. A collapsible chair, comprising:

a pair of front legs, a pair of rear legs, a pair of back support rods, a seat having a first side and a second side, wherein the first and second sides of the seat are coupled along at least part of their length to the pair of rear legs, respectively, such that the seat is supported between the rear legs;

wherein the pair of front legs and the pair of rear legs are rotatably coupled to each other, respectively, and wherein the pair of back support rods are pivotably coupled to the rear legs, respectively;

a cross brace with a first and second end, wherein the first end of the cross brace is coupled to one of the rear legs, wherein the second end of the cross brace is coupled to one of the back support rods; and wherein the front legs, the rear legs, the cross brace, and the back support rods are coupled in a manner such that the chair collapses in a single movement in which the front legs approximate each other when the seat pivots towards the back support rods.

16. The chair of claim 15 further comprising a back rest coupled to the pair of back support rods and continuous with the seat.

17. The chair of claim 15 further comprising a second cross brace that couples the other one of the front legs to one of the rear legs.

* * * * *